US006721977B2

(12) United States Patent
Solesbee et al.

(10) Patent No.: US 6,721,977 B2
(45) Date of Patent: Apr. 20, 2004

(54) MEDICAL PROCEDURE TABLE PAD

(76) Inventors: Angela Solesbee, 6 Bethany Woods Dr., Asheville, NC (US) 28805; Irene B. Hebert, 6 Bethany Woods Dr., Asheville, NC (US) 28805

( * ) Notice: Subject to any disclaimer, the term of this patent is extended or adjusted under 35 U.S.C. 154(b) by 0 days.

(21) Appl. No.: 10/206,260

(22) Filed: Jul. 26, 2002

(65) Prior Publication Data

US 2003/0033675 A1 Feb. 20, 2003

Related U.S. Application Data

(60) Provisional application No. 60/310,174, filed on Aug. 3, 2001.

(51) Int. Cl.[7] ..... A47C 20/00
(52) U.S. Cl. ..... 5/635; 5/632; 5/621
(58) Field of Search ..... 5/632, 635, 658, 5/953, 621, 639

(56) References Cited

U.S. PATENT DOCUMENTS

| | | | | | |
|---|---|---|---|---|---|
| 5,494,051 | A | * | 2/1996 | Schneider, Sr. | 5/658 |
| 5,542,136 | A | * | 8/1996 | Tappel | 5/658 |
| 5,918,331 | A | * | 7/1999 | Hall et al. | 5/658 |
| 6,049,927 | A | * | 4/2000 | Thomas et al. | 5/632 |

* cited by examiner

*Primary Examiner*—Frederick L. Lagman
(74) *Attorney, Agent, or Firm*—Carter Schnedler & Munteith

(57) ABSTRACT

There is provided a pad for a medical patient to be placed in a supine position thereon during a medical procedure which requires the use of cable in monitoring the patient during the procedure. The pad includes a cushioned substrate having a top surface adapted to contact the patient and a bottom surface adapted to contact a procedure table. The substrate has an outer edge about its periphery. An elongated channel is attached to the substrate along a portion of the outer edge. The channel is adapted to house a portion of cable which is used during a medical procedure.

18 Claims, 3 Drawing Sheets

MEDICAL PROCEDURE TABLE PAD

CROSS-REFERENCE TO PROVISIONAL PATENT APPLICATION

The benefit of U.S. Provisional Patent Application Ser. No. 60/310,174, filed Aug. 3, 2001, is claimed.

BACKGROUND OF THE INVENTION

This invention relates to pads for patients who are undergoing a medical procedure. More particularly it relates to cardiac catherization laboratory table pads.

While performing a cardiac catherization on a patient, it is essential that the patient's EKG be monitored at all times. A cardiac catherization procedure can last for 2–3 hours and it is essential that the patient lie still during the duration of the procedure. A table is used during the procedure. An elongated pad, approximately ½ inch thick, is placed on top of the metal table. The patient is placed in a supine position on the pad.

During the catherization procedure, radiation is used and is administered passing the radioactive source, in the form of a fluoroscopy tube, around portions of the patient. EKG monitors utilize a plurality of electrical cables which connect electrical sensors, which are applied to the patient, to the monitor. These cables are unorganized. Often the rotating fluoroscopy tube becomes tangled with EKG cables, resulting in abrupt and unwanted removal of the leads from the patient or disconnection of the leads from the EKG monitor. This produces an untimely loss of the EKG signal. The EKG monitor is an essential tool for monitoring the patient in cardiac rhythm.

Since radiation is used while performing this procedure, the staff must be protected. Each member of the medical staff must wear a leaded vest, skirt, thyroid collar and glasses. This can weigh 40 pounds or more. In addition, staff wears a gown, mask, hat and gloves. When the EKG cables become disconnected or the patient becomes uncomfortable, addition time is required for the procedure, thereby placing staff members at higher risks for increased radiation and adding to the stress of the patient.

In addition, longer procedures result in increased use of energy since the temperature of the room is normally maintained at around 60° to prevent overheating and potential shutdown of the equipment.

Also, it has been found that unorganized cables can interfere with the quality of the images from the fluoroscopy tube.

OBJECTS OF THE INVENTION

It is therefore one object of this invention to provide an improved medical procedure patient pad.

It is another object of this invention to provide a medical procedure patient pad which maintains cables in an organized fashion.

It is still another object to provide cardiac catherization laboratory table pad which prevents EKG cables from being disconnected and/or removed from the patient.

It is yet another object to provide quick access to monitor cable used during a medical procedure.

SUMMARY OF THE INVENTION

In accordance with one form of this invention there is provided a pad for a patient to be placed in a supine position thereon during a medical procedure which requires the use of cable in monitoring the patient. The pad includes a cushioned substrate. The substrate has a top surface adapted to contact the patient. A cable organizer mechanism, preferably a channel, is attached to the substrate. The channel is adapted to house a portion of cable which is used during a medical procedure. Preferably, the channel is elongated and is attached to a portion of the outer edge of the substrate.

BRIEF DESCRIPTION OF THE DRAWINGS

The subject matter which is regarded as the invention as set forth in the appended claims, the invention itself however, together with further objects and advantages thereof may be better understood in reference to the accompanying drawings in which:

DESCRIPTION OF THE PREFERRED EMBODIMENT

Figure 1:
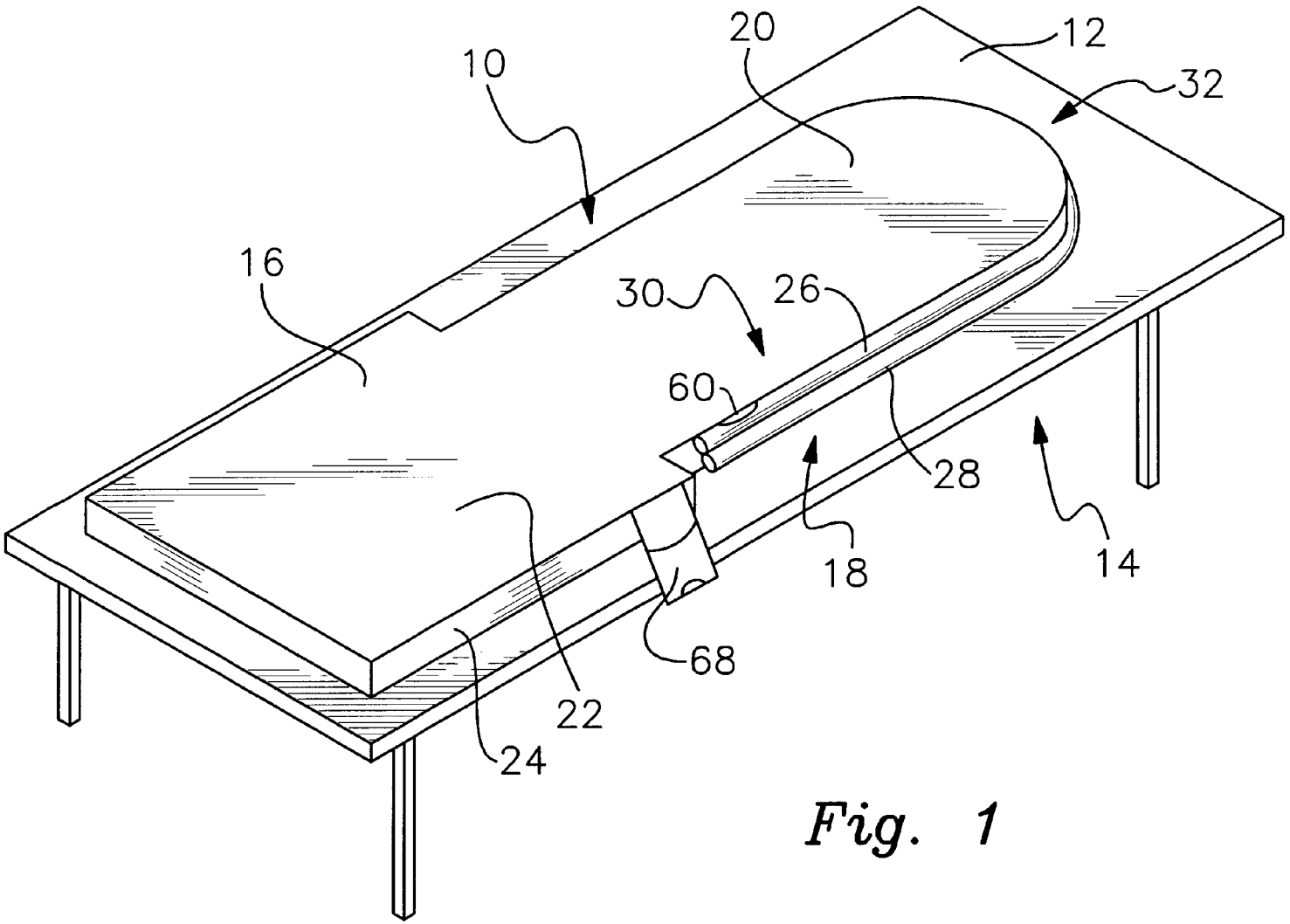
FIG. 1 is a perspective view of one form of the pad of the subject invention resting on a medical procedure table.

Referring now more particularly to FIG. 1, there is provided medical patient pad 10 resting on the upper surface 12 of medical procedure table 14. Table 14 is shown to be rectangular with legs about the periphery for illustration purposes only. Table 14 would be shaped like pad 10 and would be mounted on a central pedestal. Pad 10 includes substrate 16 and a cable organizer section 18 attached thereto. As used herein, the word "cable" includes insulated electrical conductors, electrical cable, pneumatic tubing, and other elongated apparatus used during medical procedures.

Figure 5:
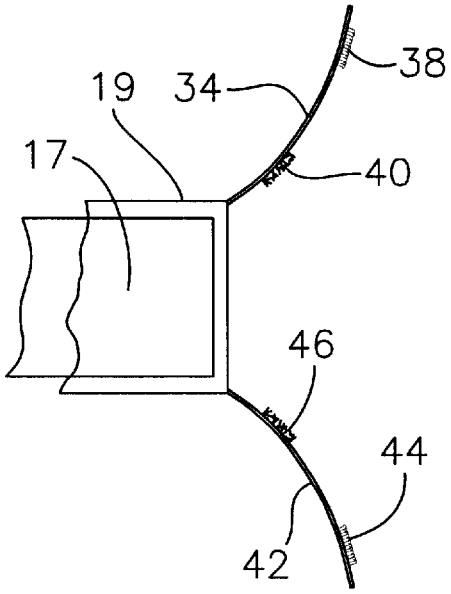
FIG. 5 is a partial side view of one edge of the pad of FIG. 1 showing the channels in the open position.
Figure 6:
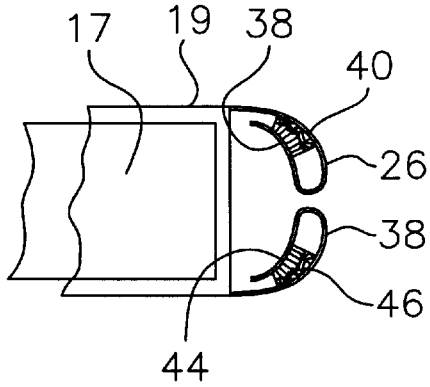
FIG. 6 is a partial side view of the one edge of pad of FIG. 1 showing the channels in the closed position.

Substrate 16 preferably includes a cushiony or gel core 17 made of a material, such as foam rubber, covered by a nonabsorbent washable material, such as soft vinyl 19, as shown in FIGS. 5 and 6.

Substrate 16 includes upper portion 20 adapted to receive the patient's head and torso, and lower portion 22 adapted to receive the patient's legs and feet.

Pad 10 of the subject invention is particularly adapted to be used during cardiac catherization procedures. During that procedure, the patient's EKG, blood pressure and blood oxygen content are continuously monitored. This results in a substantial number of unorganized wires, cable and tubing which can interfere with the catherization procedure. Substrate 16 has been modified by the addition of cable organizer section 18 which is connected around about a portion of the outer edge 24 of the substrate.

In the preferred embodiment, cable organizer section 18 includes channel 26 and channel 28. As used herein, channel means conduit, a tray, a pocket, straps and open loops, as well as other mechanisms for organizing cable. Channels 26 and 28 extend about at least a portion of outer edge 24 of substrate 16. In the preferred embodiment, channels 26 and 28 are attached to portion 30 of one of the long edges of substrate 16 and is further attached to portion 32 of the curved top edge of substrate 16.

Figure 4:
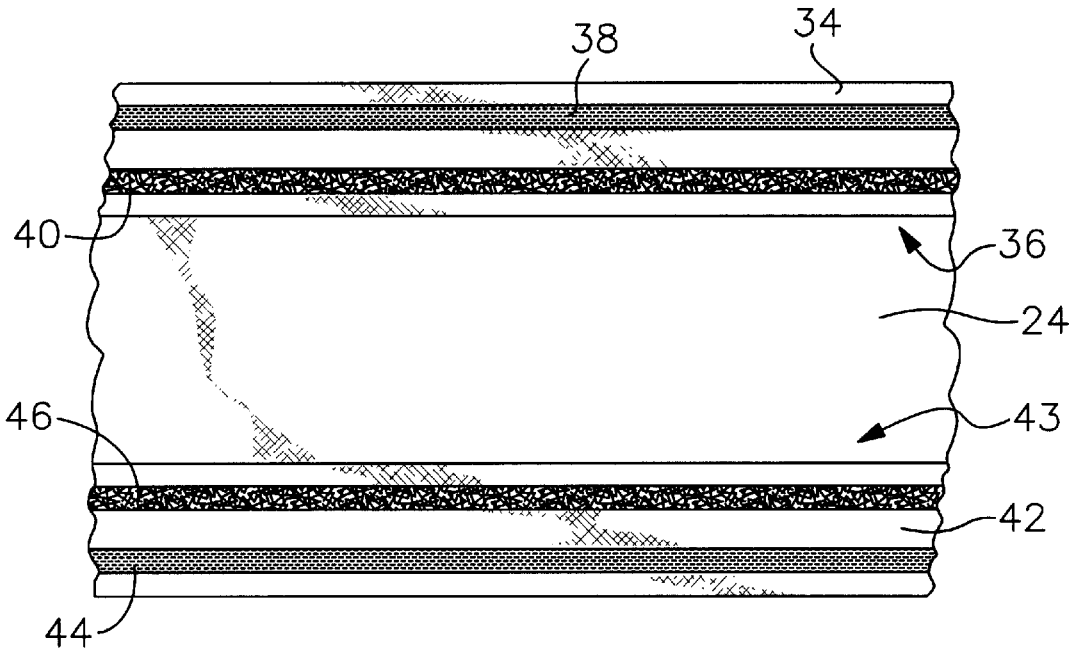
FIG. 4 is a partial side view of a portion of the pad of FIG. 1, however, with the channels in the open position.

As can be seen by FIGS. 4, 5 and 6, channel 26 is formed from flap 34, which is attached to the upper portion 36 of edge 24, preferably by sewing. Preferably, hook and loop type connectors, such as Velcro connectors, are used to form channels 26 and 28. An elongated hook connecter 38 is attached to the outer portion of the inside of flap 34, and an elongated strip of loop connecters 40 is attached to the inner portion of the inside of flap 34. Channel 26 is formed by bending flap 34 into a curved shape, as illustrated in FIG. 6 and attaching hook the connector 38 to loop connector 40.

As can be seen by FIGS. 4, 5 and 6, channel 28 is formed from flap 42, which is attached to the lower portion of edge 34, preferably by sewing. Hook connecter 46 is attached to the outer portion of the inside of flap 42, and loop connecter 48 is attached to the inner portion of the inside of flap 42. Channel 28 is formed by bending flap 42 into a curved shape, as illustrated in FIG. 6 and attaching the hook connector 46 to loop connector 48.

Figure 2:
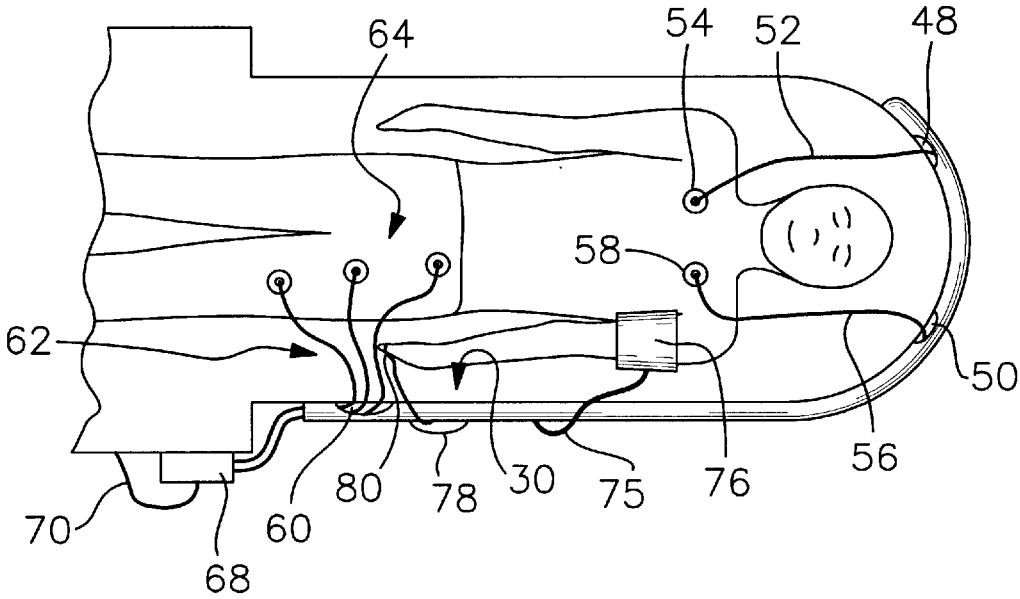
FIG. 2 is a partial top view of the pad of FIG. 1 showing a patient in a supine position on the pad and connected to EKG cable.
Figure 3:
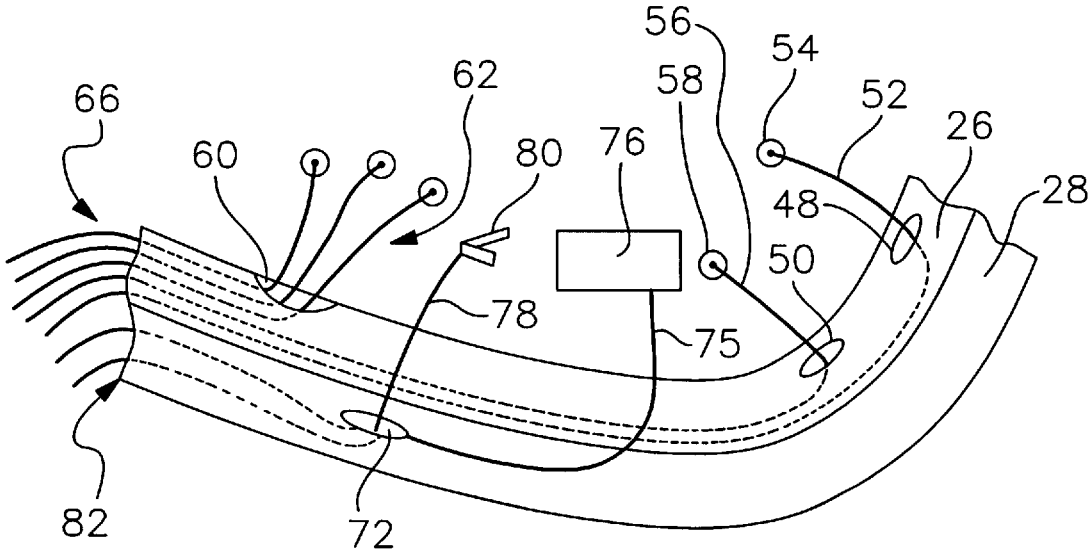
FIG. 3 is a partial side view showing a portion of the channels which form part of the pad in detail.

Referring to FIGS. 2 and 3, channel 26 preferably houses EKG cables while channel 28 preferably houses blood pressure cuff cable (i.e., a pneumatic tube) and blood oxygen sensor cable. By housing these cables within channels 26 and 28, the cable is "managed" so that it will not interfere with the medical procedure, such as a heart catherization procedure.

Channel 26 includes first slit or opening 48 and second slit or opening 50 along the top edge 32 of substrate 16.

EKG cable 52, which has sensor 54 attached thereto, passes through slit 48, and EKG cable 56, which has sensor 58 attached thereto, passes through slit 50. As can be seen in FIG. 2, sensors 54 and 58 are affixed to the patient's chest. Other portions of cables 52 and 56 are received inside channel 26. Channel 26 also includes slit 60 located along long edge 30 of substrate 16. Three EKG cables 62 having sensors 64 attached thereto, which are adapted to be attached to the lower portion of the patient, pass through slit 60. Additional portions of cables are received in the inside of channel 26. These five EKG cables 52, 56 and 62 pass out through open end 66 of channel 26 into pocket 68, which is attached to substrate 16. The individual cables 52, 56 and 62 are formed into a single larger cable 70, which is attached to the EKG box, which is under table 14 (not shown).

Channel 28 includes slit or opening 72. Blood pressure tube 75, which is attached to blood pressure cup 76, passes through slit 72. Additional portions of tube 75 are received inside channel 28. Cable 78, which is attached to blood oxygen sensor 80, also passes through slit 72. Additional portions of tube 75 and cable 78 are received in channel 28 and exit channel 28 at its open end 82 and are respectively connected to a blood pressure monitoring device (not shown) and a blood oxygen sensor device (not shown).

The improved pad 10 permits EKG cables to be held securely within channel 26, and blood pressure tubing and blood oxygen sensor cable to be held securely within channel 28. Loss of EKG and other monitoring is prevented, which is often caused by the moving fluoroscopy tube becoming entangled with the cable. The cable is prevented from coming into view of the imaging apparatus in the case of a cardiac catherization procedure. Damage to the cable is prevented. Inaccessibility to the cables is avoided since the cables are organized. In addition, damage from blood or bodily fluid is also prevented.

By organizing EKG cables in channel 26, which can be readily opened and closed, quick assessment and quick accessibility of the EKG is permitted. Pad 10 will prevent unwanted disconnections of the EKG during a procedure, which posses a potential danger to the patient should the catheter be engaged in the coronary and EKG is lost. The EKG cable will be protected from undue damage that might result from being removed abruptly by the equipment during the examination. Because the cable is housed in channel 26, placing tension on the cable is avoided, which could cause irritation and discomfort to the patient's skin. Because of the integrity of the EKG, the length of the procedure should be decreased. Frustration and stress of monitoring a patient appropriately by both the physician and the staff is diminished greatly. This system allows for quick application of EKG leads in both routine and emergency situations. The use of the new pad 10 decreases potential radiation exposure to the staff members involved in the procedure.

From the foregoing description of the preferred embodiment of the invention, it will be apparent that many modifications may be made therein. It should be understood however, that the embodiment of the invention is an exemplification of the invention only and that the invention is not limited thereto. For example, the invention is not only useful for cardiac catherization procedures, but for any other medical procedure in which cables may be used to connect the patient to equipment. It is to be understood therefore that it is intended in the appended claims to cover all modifications as fall within the true spirit and scope of the invention.

What is claimed is:

1. A pad for a patient to be placed in a supine position thereon during a medical procedure which requires the use of cables in monitoring the patient comprising:

a cushioned substrate; said substrate having a top surface adapted to contact the patient;

a first channel attached to said substrate; said first channel adapted to house a portion of the cables which is used during the medical procedure; and said substrate has an outer edge about its periphery; said first channel attached to said substrate along a portion of said outer edge.

2. A pad as set forth in claim 1, wherein said outer edge includes at least one side edge extending for the length of said pad; said first channel attached to at least a portion of said side edge.

3. A pad as set forth in claim 1, wherein said outer edge includes at least one top edge extending along the top of said pad; said first channel attached to at least a portion of said top edge.

4. A pad as set forth in claim 3, wherein the patient's head is adapted to be positioned near said top edge.

5. A pad as set forth in claim 1, wherein said outer edge includes at least one side edge extending along the length of said pad; said first channel attached to at least a portion of said side edge; said outer edge further including at least one top edge extending along the top of said pad; said first channel attached to at least a portion of said top edge.

6. A pad as set forth in claim 5, wherein said first channel has a plurality of openings for attaching cables to the patient and to at least one medical monitor.

7. A pad as set forth in claim 6, further including a pocket attached to said substrate for receiving cable from at least one of said openings for attachment to said at least one medical monitor.

8. A pad as set forth in claim 1, wherein said first channel includes a mechanism for opening and closing said first channel along its length, whereby said cable may be readily placed in said channel and removed from said channel.

9. A pad as set forth in claim 8, wherein said first channel is formed by an elongated flap having one end attached to said outer edge of said substrate; said mechanism including a first connector member attached to said flap and a second connector member attached to said flap removed from said first connector member; said first and second connector members being intermateable.

10. A pad as set forth in claim 9, wherein said first connector member is a hook type fastener and said second connector member is a loop type fastener.

11. A pad as set forth in claim 1, wherein said first channel is normally closed when said first channel receives the cable, thereby forming a hollow conduit; said first channel being readily openable to facilitate the placement of the cable therein and to facilitate the removal of the cable therefrom.

12. A pad as set forth in claim 1, further including a second channel also adapted to house additional cable; said second channel attached to a portion of said outer edge of said substrate; said additional cable adapted to be received in said second channel being for a different purpose than the cable adapted to be received in said first channel.

13. A pad as set forth in claim 1, wherein the cable adapted to be received in said first channel is an EKG cable.

14. A pad as set forth in claim 12, wherein said additional cable adapted to be received in said second channel is blood pressure monitoring tubing and blood oxygen sensor cable.

15. A pad for a patient to be placed in a supine position thereon during a medical procedure which requires the use of cables in monitoring the patient comprising:

a cushioned substrate; said substrate having a top surface adapted to contact the patient;

a first channel attached to said substrate; said first channel adapted to house a portion of the cables which is used during the medical procedure; and the bottom surface is adapted to contact a procedure table.

16. A pad for a patient to be placed in a supine position thereon during a medical procedure which requires the use of cable in monitoring the patient comprising:

a cushioned elongated substrate; said substrate having a top surface adapted to contact the patient and a bottom surface adapted to contact a procedure table;

a first elongated channel attached to said substrate; said first channel adapted to house a portion of the cable which is used during the medical procedure;

said substrate has a top edge and a side edge about a portion of its periphery; said first channel attached to said substrate along at least a portion of said top edge and said side edge.

17. A pad as set forth in claim 16, wherein said cable is a plurality of EKG cables; first and second openings in a portion of the first channel attached to said top edge so that EKG cable may pass through said first and second openings and be attached to the patient; second and third openings in said first channel along said side edge so that said EKG cable may pass through said third opening and be attached to the patient and so that said EKG cable may pass through said fourth opening and be connected to an EKG monitoring device.

18. A pad for a patient to be placed in a supine position thereon during a medical procedure which requires the use of cable in monitoring the patient comprising:

a cushioned elongated substrate; said substrate having a top surface adapted to contact the patient and a bottom surface adapted to contact a procedure table;

a first elongated channel attached to said substrate; said first channel adapted to house a portion of the cable which is used during a medical procedure;

said substrate has an outer edge about its periphery; said first channel attached to said substrate along a portion of said outer edge;

said outer edge includes at least one side edge extending for the length of said substrate; said first channel attached to at least a portion of said side edge;

said outer edge further including at least one top edge extending along the top of said substrate; said first channel attached to at least a portion of said top edge;

said first channel has a plurality of openings for attaching cable to the patient and to at least one medical monitor;

said first channel includes a mechanism for opening and closing said first channel along its length, whereby said cable may be readily placed in said channel and removed from said channel;

said first channel is formed by an elongated flap having one edge attached to said paid; said mechanism including a first connector member attached to said flap and a second connector member attached to said flap removed from said first connector member; said first and second connector members being intermateable;

said first connector member is a hook type fastener and said second connector member is a loop type fastener.

* * * * *